US007581388B2

(12) United States Patent
Colignon

(10) Patent No.: US 7,581,388 B2
(45) Date of Patent: Sep. 1, 2009

(54) SYSTEM FOR PURGING SULFATE FROM A NOX TRAP FOR A MOTOR VEHICLE ENGINE

(75) Inventor: Christophe Colignon, Levallois Perret (FR)

(73) Assignee: Peugeot Citroen Automobiles SA, Velizy Villacoublay (FR)

( * ) Notice: Subject to any disclaimer, the term of this patent is extended or adjusted under 35 U.S.C. 154(b) by 191 days.

(21) Appl. No.: 10/595,823

(22) PCT Filed: Nov. 12, 2004

(86) PCT No.: PCT/FR2004/002908

§ 371 (c)(1),
(2), (4) Date: May 12, 2006

(87) PCT Pub. No.: WO2005/064142

PCT Pub. Date: Jul. 14, 2005

(65) Prior Publication Data

US 2007/0125068 A1 Jun. 7, 2007

(30) Foreign Application Priority Data

Nov. 25, 2003 (FR) ..... 03 13827

(51) Int. Cl.
*F01N 3/00* (2006.01)

(52) U.S. Cl. ..... 60/295; 60/285; 60/301

(58) Field of Classification Search ..... 60/295, 60/274, 285, 301
See application file for complete search history.

(56) References Cited

U.S. PATENT DOCUMENTS 5,778,666 A 7/1998 Cullen et al.
6,615,577 B2 9/2003 Meyer et al.
6,637,198 B2 10/2003 Hertzberg
6,722,236 B1 4/2004 Baldini et al.
6,823,657 B1 * 11/2004 Waschatz et al. ..... 60/274
6,823,664 B2 * 11/2004 Nakatani et al. ..... 60/295
6,962,045 B2 * 11/2005 Kitahara et al. ..... 60/295
7,127,883 B1 10/2006 Kaneko et al.
7,152,397 B2 12/2006 Colignon
7,191,590 B2 * 3/2007 Nagaoka et al. ..... 60/285
7,197,867 B2 * 4/2007 Huang et al. ..... 60/295
7,225,608 B2 * 6/2007 Audouin ..... 60/285
2007/0113545 A1 * 5/2007 Colignon ..... 60/286

FOREIGN PATENT DOCUMENTS

DE 10142669 A 4/2003
EP 0892158 A 1/1999
EP 1353048 A 10/2003

OTHER PUBLICATIONS

International Search Report dated Feb. 24, 2005.

* cited by examiner

*Primary Examiner*—Thomas E Denion
*Assistant Examiner*—Diem Tran
(74) *Attorney, Agent, or Firm*—Nicolas E. Seckel

(57) ABSTRACT

System in which the NOx trap is associated with a catalyst integrated in an exhaust line of a vehicle engine, and in which the engine is associated with common manifold or "rail" fuel feeder for feeding it with fuel and adapted, by modifying control parameters for the operation of the engine, to cause the engine to switch between lean mixture operation and rich mixture, in which the fuel feeder is adapted to define three strategies for controlling lean mixture operation of the engine, and to cause the engine to switch between its various strategies in order to keep the trap in a temperature window of maximum effectiveness.

10 Claims, 2 Drawing Sheets

SYSTEM FOR PURGING SULFATE FROM A NOX TRAP FOR A MOTOR VEHICLE ENGINE

BACKGROUND ART

The present invention relates to a system for purging sulfate from a NOx trap associated with oxidation catalyst-forming means and integrated in an exhaust line of a motor vehicle engine.

More particularly, the invention relates to such a system in which the engine is associated with common manifold or "rail" fuel feeder means for feeding the cylinders of the engine with fuel and adapted, by modifying the engine operation control parameters, to cause the engine to switch between operating with a lean mixture and operating with a rich mixture.

It is known that in order to treat polluting emissions in compliance with regulations, and in particular for diesel-engined vehicles, various types of function are needed, in particular an oxidation function for treating carbon monoxide (CO) and hydrocarbons (HCs), a function of reducing nitrogen oxides, and a filter function associated with a particle-combustion function.

One of the means for reducing nitrogen oxides is to use a NOx trap.

The impregnation in the trap then contains storage elements, e.g. barium, on which nitrogen oxides become fixed in the form of nitrates.

When the trap is exposed to sulfur dioxide ($SO_2$) formed from the sulfur contained in the fuel and the lubricating oil of the engine, sulfates are formed, e.g. barium sulfate, and these are compounds that are more stable than nitrates.

Regenerating the NOx trap then serves to convert the nitrogen oxides, but does not eliminate the sulfates. The trap thus becomes progressively saturated in sulfates, thereby having the effect of reducing the catalytic performance of the trap (NOx conversion and also conversion of CO and HC).

It is therefore necessary to purge sulfates regularly from the trap in order to eliminate the sulfates that have become stored therein.

Purging sulfates from a NOx trap can be performed effectively only under precise conditions of temperature and gas composition.

The medium needs to be rich in reducing agents, so the engine must be operating in rich mode and at high temperature, given that sulfates are compounds that are very stable, thermodynamically speaking.

Two problems then arise for obtaining effective sulfate purging.

Firstly, the higher the temperature, the more effective the desorption, but also the faster the trap is caused to age, which leads to reduced catalytic effectiveness.

It is therefore necessary to avoid heating the trap excessively so as to maintain its performance over the lifetime of the vehicle.

Furthermore, sulfates are released essentially in the form of hydrogen sulfide $H_2S$ or of $SO_2$, with other compounds such as COS being given off in much smaller quantities.

Sulfates are preferably desorbed in the form of $H_2S$ (an evil-smelling gas) when the medium is deficient in oxygen. This is normally the case while the engine is operating with a rich mixture.

However, the formulation of a NOx trap may contain elements with oxygen storage capacity (OSC) that release oxygen when the medium is poor in oxidizing species.

Thus, when the engine switches over from operating in rich mode to poor mode, the OSC releases oxygen.

Unfortunately, the OSC is not an infinite supply of oxygen and, after a certain length of time, it is used up. Thus, while purging sulfate, when the temperature is high enough to be able to release sulfates, they are initially desorbed in the form of $SO_2$, then when there is no longer enough oxygen in the gas (e.g. the OSC reservoir is empty), they are desorbed in the form of $H_2S$.

SUMMARY OF THE INVENTION

The object of the invention is thus to provide a system that makes it possible to keep the NOx trap in a temperature window of maximum effectiveness, while minimizing the risk of aging the impregnated catalyst and while limiting as much as possible any emission of $H_2S$ gas during a sulfate purge operation.

To this end, the invention provides a system for purging sulfate from a NOx trap associated with oxidation catalyst-forming means, and integrated in an exhausted line of a motor vehicle diesel engine, in which the engine is associated with common manifold or "rail" fuel feeder means for feeding fuel to the cylinders of the engine and adapted, by modifying engine operation control parameters, to cause the engine to switch between operating with a lean mixture and with a rich mixture, the system being characterized in that the fuel feeder means are adapted to define three strategies for controlling the operation of the engine with a lean mixture for the purpose of obtaining different temperature levels in the exhaust line, the first strategy being referred to as a normal strategy and corresponding to normal operation of the engine, the second strategy being referred to as a level 1 strategy, and the third strategy being referred to as a level 2 strategy, the temperature level obtained by applying the third, level 2 strategy being higher than that obtained by applying the second, level 1 strategy, which is itself higher than that obtained by applying the first, normal strategy, and in that the fuel feeder means are connected to:

- means for detecting a request to purge sulfate so as to control the feeder means in order to engage operation of the engine in the second, level 1 strategy;
- means for monitoring the activation state of the catalyst-forming means to engage the third, level 2 strategy;
- means for acquiring the temperature level in the exhaust line for engaging operation of the engine with a rich mixture when this temperature level exceeds a predetermined target temperature during a predetermined first time period or for switching off sulfate purging if this temperature is not reached before a predetermined maximum second time period expires; and
- means for monitoring the rich mixture operation of the engine:
  - to cause the engine to operate in lean mixture in the third, level 2 strategy at the end of a third predetermined time period;
  - to cause the engine to operate with a lean mixture in a third, level 2 strategy if the temperature level in the exhaust line drops below a predetermined low temperature threshold during a fourth time period;
  - to cause the engine to operate with a lean mixture in a second, level 1 strategy if the temperature level in the exhaust line exceeds a predetermined high temperature threshold during a fifth time period;
  - to maintain the engine operating in this second, level 1 strategy during a predetermined forcing sixth time period or until the moment when the temperature level in the exhaust line has dropped back below the high temperature threshold minus an hysteresis offset during a seventh time period;

to cause the engine to operate with a lean mixture a first, normal strategy when the temperature level in the exhaust line has not dropped back below the high temperature threshold minus the hysteresis offset at the end of a maximum cooling eighth time period, until the temperature level in the exhaust line has dropped back below said high temperature threshold minus the hysteresis offset during the seventh time period;

to maintain the operation of the engine in lean mode in one of the following strategies: level 2, level 1 or normal, as defined above, during a ninth time period; and at the end of said ninth time period, if the temperature level in the exhaust line lies between the predetermined target temperature and the high temperature threshold, to loop control of the engine back starting from operation with a rich mixture until a request is detected to stop sulfate purging, said request being detected by corresponding detector means.

According to other characteristics:

the threshold temperatures are calibratable;

the time periods are calibratable;

it includes means for issuing the sulfate purging request and the request to stop sulfate purging;

the means for monitoring the activation state of the catalyst-forming means and the temperature level acquisition means in the exhaust line comprise temperature sensors; and the fuel feeder means are adapted to take account of aging of the trap.

BRIEF DESCRIPTION OF THE DRAWING

The invention can be better understood on reading the following description given purely by way of example and made with reference to the accompanying drawings, in which.

DETAILED DESCRIPTION OF PARTICULAR EMBODIMENTS

Figure 1:
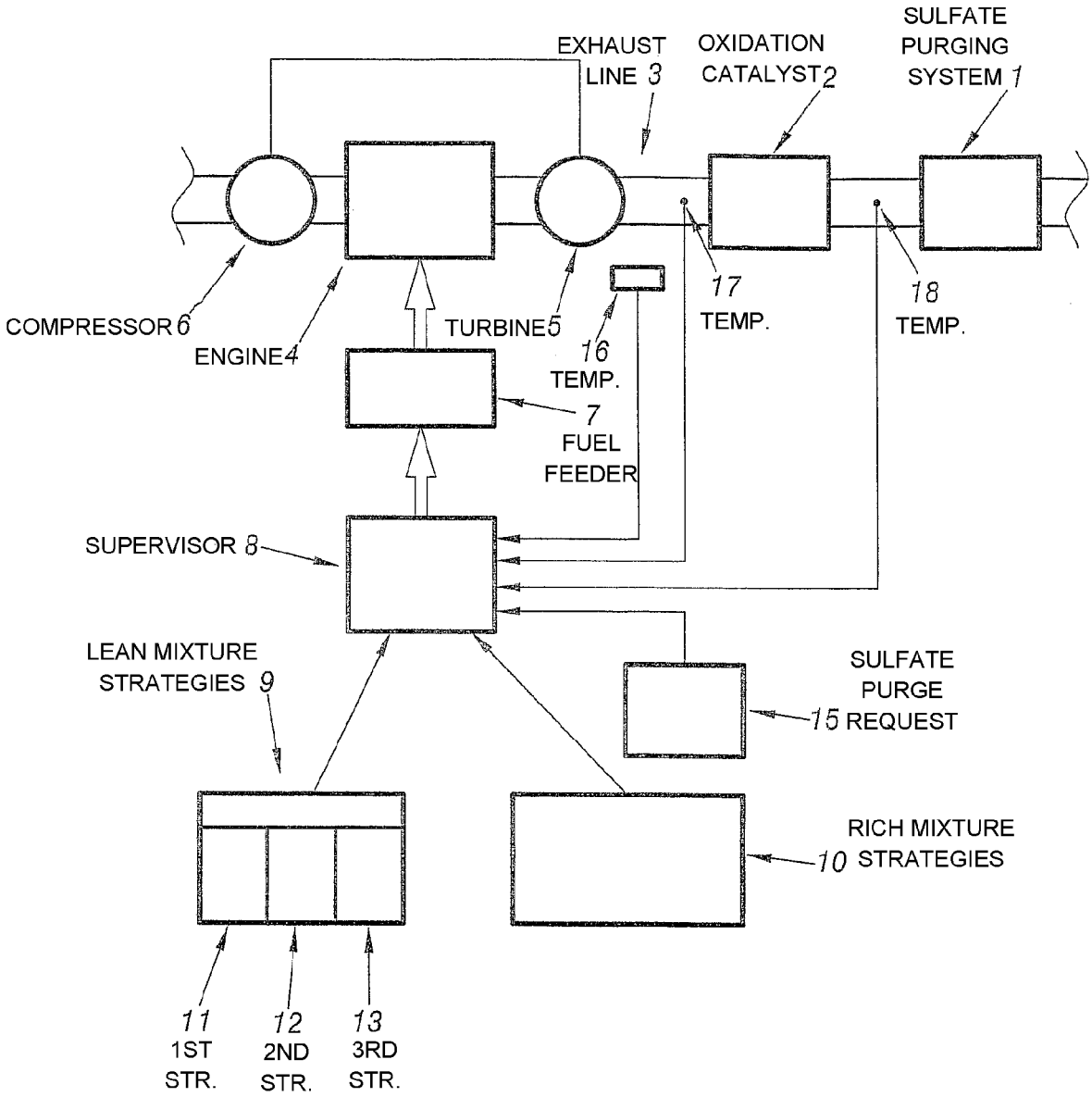
FIG. 1 is a block diagram showing the general structure of a system of the invention.

FIG. 1 shows a sulfate purging system for a NOx trap given overall reference 1 in this figure, associated with oxidation catalyst-forming means given overall reference 2, and integrated in an exhaust line 3 of a motor vehicle diesel engine.

The engine is given overall reference 4, and by way of example it is associated with a turbo charger, having a turbine portion 5 placed in the exhaust line and having a compressor portion 6 placed upstream from the engine.

The engine is associated with common manifold or "rail" fuel feeder means 7 for feeding the cylinders of the engine with fuel and adapted, by modifying the engine operating control parameters, to cause the engine to switch between operating with a lean mixture and operating with a rich mixture.

This is then performed in conventional manner under the control of a supervisor given overall reference 8, on the basis of strategies for controlling lean mixture operation and rich mixture operation, given respective overall references 9 and 10.

These fuel feeder means and the supervisor are adapted to define three strategies or controlling the (operation of the engine with a lean mixture, the first of these strategies 11, being referred to as a "normal" strategy and corresponding to normal operation of the engine, the second strategy, 12, being referred to as a "level 1" strategy, and the third strategy 13 being referred to as a "level 2" strategy.

This then makes it possible by controlling the operation of the engine to obtain different temperature levels in the exhaust line, the temperature level obtained by applying the third, level 2 strategy 13 being greater than that obtained by applying the second, level 1 strategy 12, which is itself greater than that obtained by applying the first, normal strategy 11.

The supervisor 8 is also connected to means for issuing a request to purge sulfate from the NOx trap or to stop such purging, given overall reference 15, and to various temperature sensors, e.g. l6, 17 and 18, that are distributed along the exhaust line in order to acquire the temperature levels therein, as described in greater detail below.

The temperature sensor 16 is adapted to acquire the temperature level in the exhaust line, while the sensors 17 and 18 placed on either side of the catalyst-forming means serve to determine the activation state thereof, for example, in conventional manner.

Figure 2:
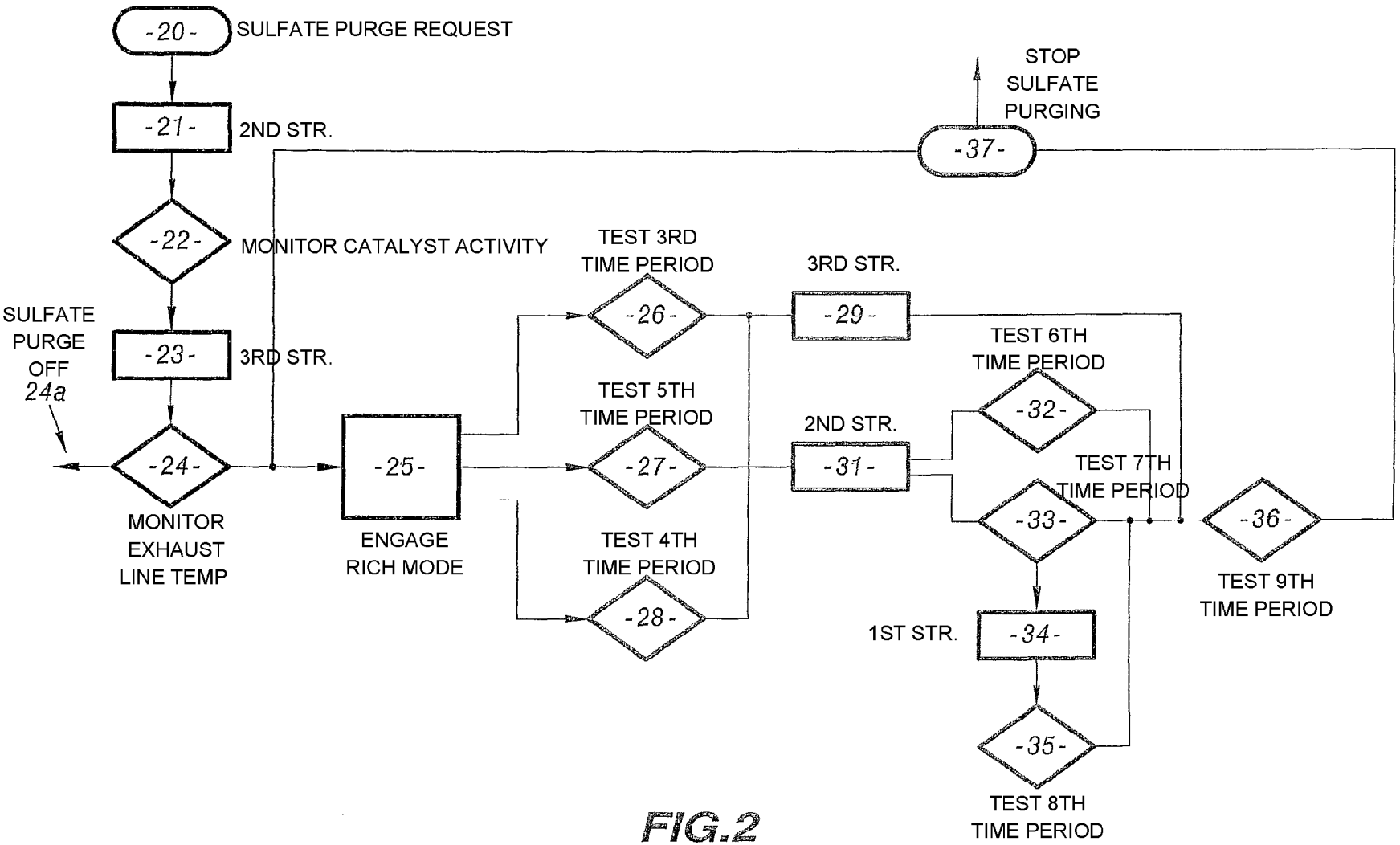
FIG. 2 is at flowchart showing the operation thereof.

The operation of this system is shown in FIG. 2, and begins by the supervisor 8 receiving a sulfate purge request from the fuel feeder means, in a step 20.

On detecting this sulfate purge request, the fuel feeder means 7, 8 are adapted to engage engine operation in the second, level 1 strategy, in a step 21.

The supervisor then monitors the activation state of the catalyst-forming means in a step 22 so that when the catalyst-forming means are active, the third strategy at level 2 is triggered in a step 23.

Thereafter, in a step 24, the supervisor monitors the temperature level in the exhaust line 3 of the engine in order to engage engine operation in its rich mode in a step 25 when this temperature level exceeds a predetermined target temperature during a predetermined first time period.

The supervisor 8 is also adapted to switch off sulfate purging in a step 24*a* if this target temperature is not reached before the expiry of a predetermined maximum second time period.

If the test in step 24 is positive, then the supervisor 8 is adapted to monitor the rich mode operation of the engine and to detect conditions under which three tests 26, 27 and 28 respectively are passed.

Starting from the engine operating in rich mode, the means for monitoring the operation of the engine are adapted to control said engine to operate with a lean mixture using the level 2 strategy in a step 29 at the end of a third predetermined time period from the test in step 26, to cause the engine to operate with a lean mixture in the third, level 2 strategy in a step 29 if the temperature level in the exhaust line drops below a predetermined low temperature threshold during a fourth period of time from the test performed in step 28, or to cause the engine to operate with a lean mixture in the second, level 1 strategy in a step 31 if the temperature level in the exhaust line exceeds a predetermined high temperature threshold during a fifth period of time from the test performed in step 27.

The supervisor 8 then maintains the engine operating in this second, level 1 strategy of step 31 for a predetermined forcing sixth time period in a step 32, or until the temperature level in the exhaust line has dropped below the high temperature threshold minus an hysteresis offset during a seventh time period, in a step 33.

Otherwise, the supervisor is adapted to cause the engine to operate with a lean mixture in a step 34 using the first, normal strategy when the temperature level in the exhaust line does not drop below the high temperature threshold minus a hysteresis offset by the end of a maximum eighth time period for cooling down, until the temperature level in the exhaust line has returned to below this high temperature threshold minus the hysteresis offset for the seventh time period, as shown in step 35.

The supervisor then keeps the engine operating in lean mode using one of following strategies: level 2 strategy in a step 29, level 1 strategy in a step 31, or normal strategy in a step 34, as defined above, for a ninth time period in a step 36, and when said ninth time period has expired, if the temperature level in the exhaust line lies between the predetermined target temperature and the high temperature threshold, control of the engine is looped back from operating with a rich mixture in step 25 until the supervisor 8 detects a request to stop sulfate purging in a step 37.

Under such circumstances, the timer is triggered as soon as operation goes to lean mode, and it is the total time spent in level 2, optionally plus level 1, and optionally plus normal lean mode, that is taken into consideration for this comparison.

Naturally, various threshold temperatures and the time periods mentioned above can be calibratable.

Thus, for example, the high and low threshold temperatures are safety margins which, for the high temperature threshold, serve to avoid aging the trap thermally, where such aging leads to a drop in the effectiveness of NOx, CO and HCs being converted, while the low threshold temperature represents the minimum temperature below which the sulfate purging process is too slow.

The phenomenon of trap aging leads to a reduction in its catalytic activity and this can also be taken into account by adapting the target richness in the rich mode of engine operation.

For example, with a new trap, it is possible to use richness of 1.11 ($\lambda$=0.9), and to decrease the richness progressively as the trap ages.

Typically, the richness will be 1.04 ($\lambda$=0.96) for a trap that has traveled 100,000 kilometers.

Furthermore, the duration of sulfate purging becomes progressively longer.

Several solutions can be envisaged for taking account of such aging, in particular as a function of kilometers traveled, of the calculated quantity of sulfur that has been seen by the trap, of the effectiveness of NOx conversion as measured by NOx sensors placed upstream and downstream of the trap, of the temperature levels seen by the trap and measured either in the trap or downstream from the trap, etc.

Such monitoring of the operation of the engine then makes it possible to keep the trap in a window of maximal thermal effectiveness while minimising harmful emissions and while adapting the operating strategies as a function of the aging of the trap.

Naturally, other embodiments could be envisaged.

Thus, for example, the oxidation catalyst-forming means and the NOx trap could be integrated in a single element on a common substrate.

Furthermore, a particle filter including the oxidation function could be envisaged.

Similarly, a NOx trap integrating such an oxidation function could also be envisaged, whether the trap includes an additive or otherwise.

This oxidation function and/or NOx trap function can be performed by an additive mixing with the fuel, for example.

The invention claimed is:

1. A system for purging sulfate from a NOx trap associated with oxidation catalyst-forming means, and integrated in an exhaust line of a motor vehicle diesel engine, in which the engine is associated with common manifold or "rail" fuel feeder means for feeding fuel to the cylinders of the engine and adapted, by modifying engine operation control parameters, to cause the engine to switch between operating with a lean mixture and with a rich mixture, wherein the fuel feeder means are adapted to define three strategies for controlling the operation of the engine with a lean mixture for the purpose of obtaining different temperature levels in the exhaust line, the first strategy being referred to as a normal strategy and corresponding to normal operation of the engine, the second strategy being referred to as a level 1 strategy, and the third strategy being referred to as a level 2 strategy, the temperature level obtained by applying the third, level 2 strategy being higher than that obtained by applying the second, level 1 strategy, which is itself higher than that obtained by applying the first, normal strategy, and wherein the fuel feeder means are connected to:

means for detecting a request to purge sulfate so as to control the feeder means in order to engage operation of the engine in the second, level 1 strategy;

means for monitoring the activation state of the catalyst-forming means to engage the third, level 2 strategy;

means for acquiring the temperature level in the exhaust line to engage operation of the engine with a rich mixture when this temperature level exceeds a predetermined target temperature during a predetermined first time period or for switching off sulfate purging if this temperature is not reached before a predetermined maximum second time period expires; and means for monitoring the rich mixture operation of the engine:

to cause the engine to operate in lean mixture in the third, level 2 strategy at the end of a third predetermined time period;

to cause the engine to operate with a lean mixture in a third, level 2 strategy if the temperature level in the exhaust line drops below a predetermined low temperature threshold during a fourth time period;

to cause the engine to operate with a lean mixture in a second, level 1 strategy if the temperature level in the exhaust line exceeds a predetermined high temperature threshold during a fifth time period;

to maintain the engine operating in this second, level 1 strategy during a predetermined forcing sixth time period or until the moment when the temperature level in the exhaust line has dropped back below the high temperature threshold minus an hysteresis offset during a seventh time period;

to cause the engine to operate with a lean mixture in a first, normal strategy when the temperature level in the exhaust line has not dropped back below the high temperature threshold minus the hysteresis offset at the end of a maximum cooling eighth time period, until the temperature level in the exhaust line has dropped back below said high temperature threshold minus the hysteresis offset during the seventh time period;

to maintain the operation of the engine in lean mode in one of the following strategies: level 2, level 1 or normal, as defined above, during a ninth time period; and at the end of said ninth time period, if the temperature level in the exhaust line lies between the predetermined target temperature and the high temperature threshold, to loop control of the engine back starting from operation with a rich mixture until a request is detected to stop sulfate purging, said request being detected by corresponding detector means.

2. A system according to claim 1, including means for issuing the sulfate purging request and the request to stop sulfate purging.

3. A system according to claim 1, wherein the means for monitoring the activation state of the catalyst-forming means and the temperature level acquisition means in the exhaust line comprise temperature sensors.

4. A system according to claim 1, wherein the fuel feeder means are adapted to take account of aging of the trap.

5. A system according to claim 1, wherein the threshold temperatures are calibratable.

6. A system according to claim 5, wherein the time periods are calibratable.

7. A system according to claim 5, including means for issuing the sulfate purging request and the request to stop sulfate purging.

8. A system according to claim 6, including means for issuing the sulfate purging request and the request to stop sulfate purging.

9. A system according to claim 1, wherein the time periods are calibratable.

10. A system according to claim 9, including means for issuing the sulfate purging request and the request to stop sulfate purging.

* * * * *